US011226185B2

(12) United States Patent
Norris

(10) Patent No.: US 11,226,185 B2
(45) Date of Patent: Jan. 18, 2022

(54) PROJECTILE HAVING ADAPTIVE EXPANSION CHARACTERISTICS

(71) Applicant: Wayne B. Norris, Santa Barbara, CA (US)

(72) Inventor: Wayne B. Norris, Santa Barbara, CA (US)

( * ) Notice: Subject to any disclaimer, the term of this patent is extended or adjusted under 35 U.S.C. 154(b) by 0 days.

(21) Appl. No.: 17/057,773

(22) PCT Filed: Jun. 5, 2019

(86) PCT No.: PCT/US2019/035579
§ 371 (c)(1),
(2) Date: Nov. 23, 2020

(87) PCT Pub. No.: WO2019/236704
PCT Pub. Date: Dec. 12, 2019

(65) Prior Publication Data

US 2021/0223014 A1 Jul. 22, 2021

Related U.S. Application Data

(60) Provisional application No. 62/680,807, filed on Jun. 5, 2018.

(51) Int. Cl.
*F42B 12/60* (2006.01)

(52) U.S. Cl.
CPC ..... *F42B 12/60* (2013.01)

(58) Field of Classification Search
CPC ..... F42B 12/58; F42B 12/56; F42B 12/60; F42B 12/62; F42B 12/367; F42B 12/02; F42B 12/34
USPC ..... 102/506–510
See application file for complete search history.

(56) References Cited

U.S. PATENT DOCUMENTS

| | | | | |
|---|---|---|---|---|
| 451,088 | A | 4/1891 | Tunnigliff | |
| 854,923 | A | 5/1907 | Broad | |
| 949,028 | A | 2/1910 | Ross | |
| 1,023,469 | A | 4/1912 | Haslett | |
| 1,134,797 | A | 4/1915 | Wood | |
| 1,322,662 | A | 11/1919 | Watson | |
| 1,512,026 | A * | 10/1924 | Holden | F42B 12/34 102/509 |

(Continued)

FOREIGN PATENT DOCUMENTS

DE 4403725 A1 8/1994

*Primary Examiner* — John Cooper
(74) *Attorney, Agent, or Firm* — Endurance Law Group PLC

(57) ABSTRACT

An adaptive projectile for small caliber firearms includes preformed submunition elements deployed in a radiating pattern by a spreader upon impact with a soft target, such as the body of an assailant. But when initial impact is with an intermediate hard obstacle, a pressure-sensitive link disables the spreader so that the submunition elements will not deploy but instead become locked into a unitary, monolithic body capable of penetrating the hard obstacle. The nose of the projectile is a hollow ballistic penetrator that restrains the submunition elements upon impact with a hard object. The submunition elements rest on a base. For protection inside the gun barrel and during flight, the adaptive projectile is partially wrapped by a thin jacket that fractures and/or peals away upon impact with a soft target.

20 Claims, 9 Drawing Sheets

(56) References Cited

U.S. PATENT DOCUMENTS

| | | | | |
|---|---|---|---|---|
| 1,556,160 | A | 10/1925 | Riggs | |
| 3,427,976 | A | 2/1969 | Lucy | |
| 3,941,059 | A | 3/1976 | Cobb | |
| 4,044,685 | A | 8/1977 | Avcin | |
| 4,136,616 | A * | 1/1979 | Schirneker | F42B 12/34 102/510 |
| 4,175,492 | A | 11/1979 | Brede et al. | |
| 4,245,557 | A | 1/1981 | Knappworst et al. | |
| 4,655,140 | A | 4/1987 | Schirneker | |
| 4,665,827 | A | 5/1987 | Ellis, II | |
| 4,685,397 | A | 8/1987 | Schirneker | |
| 5,160,805 | A | 11/1992 | Winter | |
| 5,198,616 | A | 3/1993 | Anderson | |
| 5,454,325 | A | 10/1995 | LeBlanc | |
| 6,024,021 | A | 2/2000 | Schultz | |
| 6,148,731 | A | 11/2000 | Winter | |
| 6,655,295 | B2 | 12/2003 | Baumgartner et al. | |
| 6,971,315 | B2 | 12/2005 | Knappworst et al. | |
| 7,299,750 | B2 | 11/2007 | Schikora et al. | |
| 7,360,491 | B2 | 4/2008 | Sanborn | |
| 8,171,852 | B1 * | 5/2012 | Rebar | F42B 12/34 102/510 |
| 8,186,277 | B1 | 5/2012 | King | |
| 8,438,767 | B2 * | 5/2013 | Rebar | F42B 12/34 42/51 |
| 9,255,775 | B1 * | 2/2016 | Rubin | F42B 12/34 |
| 9,631,910 | B2 * | 4/2017 | Fricke | F42B 12/34 |
| 10,443,990 | B2 * | 10/2019 | Yadon | F42B 7/10 |
| 2006/0124022 | A1 | 6/2006 | Eberhart et al. | |
| 2007/0131131 | A1 | 6/2007 | Stock et al. | |
| 2008/0223246 | A1 * | 9/2008 | Dindl | F42B 12/50 102/502 |
| 2008/0314280 | A1 * | 12/2008 | Martini Filho | F42B 12/34 102/510 |
| 2010/0224093 | A1 | 9/2010 | Wilhelm et al. | |
| 2015/0308800 | A1 * | 10/2015 | Schnabel | F42B 5/025 102/507 |
| 2016/0202031 | A1 | 7/2016 | Rumfitt et al. | |
| 2016/0223307 | A1 | 8/2016 | Bray | |
| 2017/0299358 | A1 | 10/2017 | Miller et al. | |

* cited by examiner

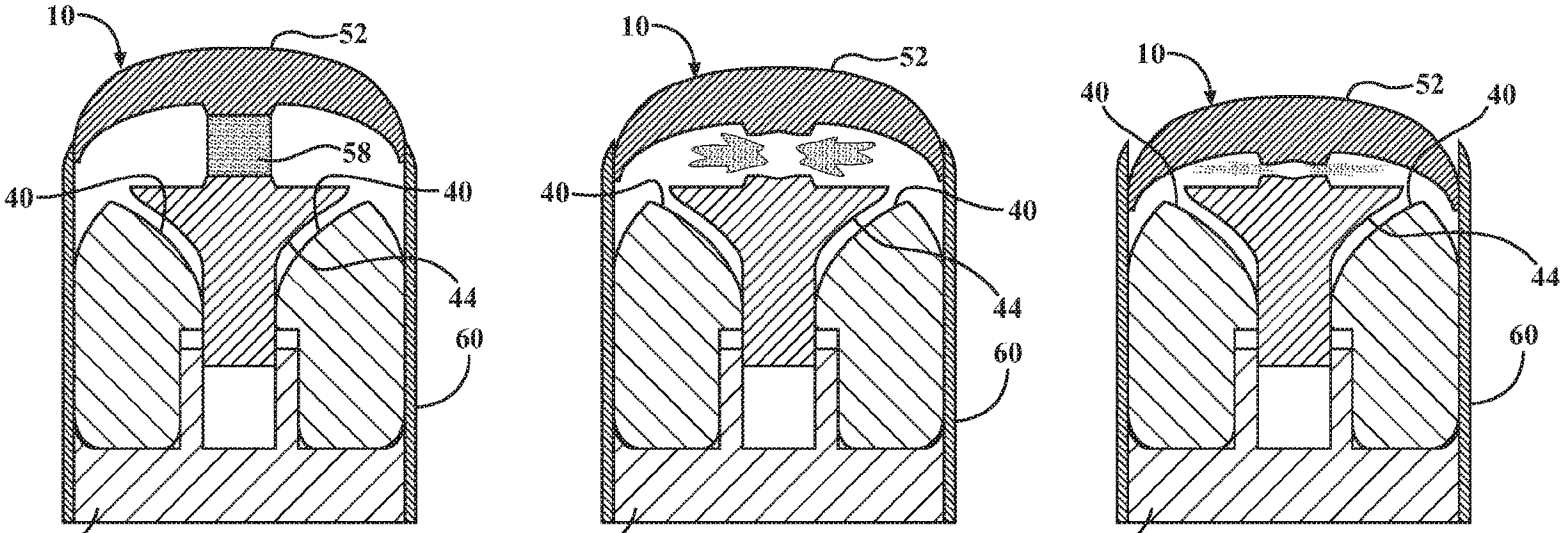
FIG. 8A
FIG. 8B
FIG. 8C
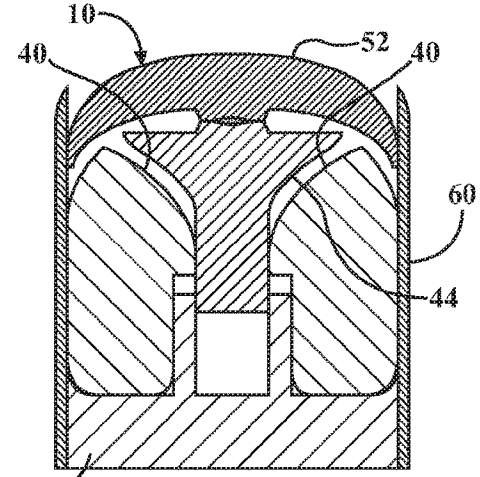
FIG. 8D
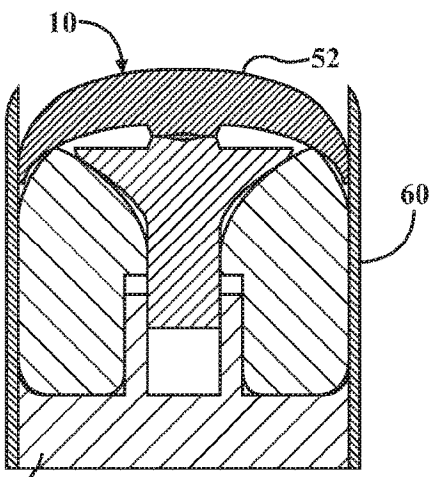
FIG. 8E

PROJECTILE HAVING ADAPTIVE EXPANSION CHARACTERISTICS

CROSS REFERENCE TO RELATED APPLICATIONS

This application claims priority to Provisional Patent Application No. 62/680,807 filed Jun. 5, 2018, the entire disclosure of which is hereby incorporated by reference and relied upon.

BACKGROUND OF THE INVENTION

Field of the Invention

The invention relates generally to a projectile which is to be propelled through air, and more particularly to such a projectile specially constructed for lateral expansion upon impact.

Description of Related Art

Light ammunition used by police and other civil authorities, and by citizens for self-protection, are intended to stop a possible attacker in a face to face engagement, producing as much stopping power and as little injury as possible. Killing or seriously wounding the attacker is a side effect of the attempt to stop and is not normally the intended objective.

Less than lethal alternatives to conventional light firearm ammunition include the so-called rubber/baton bullets and conducted electrical weapons like those marketed under the Taser® brand. Neither of these alternatives fully address the requirements of a typical law enforcement officer firefight scenario of near total darkness, 3 seconds warning or less, an engagement range of 3 to 20 feet, ability to penetrate an automobile windshield without significant loss of stopping power, and a broad requirement to take the targeted individual authoritatively out of the fight on the first shot with the lowest possible likelihood of fatality.

Maximum stopping power against soft targets such as humans is achieved through the creation of a large, disablingly painful, but shallow skin wound that is unlikely to be fatal, and which results from the efficient transfer of the projectile's (i.e., bullet's) kinetic energy to the attacker with maximum surface wound area and minimal penetration.

Despite the known advantages of energy transfer and limited penetration, the use of expanding and/or fragmenting designs in conventional light ammunition has not been widely adopted in law enforcement. One reason is that, at times, a projectile will be needed to penetrate an intermediate obstruction such as automotive glass, plastic, and metal in order to stop a would-be attacker, for example, in cases where an attacker is inside a motor vehicle. A traditional expanding/fragmenting projectile is not desirable in these situations, because most of all of the projectile energy would be dissipated on the obstruction; the projectile would not pass through to stop the driver.

The prior art has exhibited a long-felt desire to construct a projectile capable of adaptive expansion characteristics, but the dream remains elusive. For example, U.S. Pat. No. 4,136,616 to Schirneker discloses a projectile that can be manually configured prior to firing so that the front end of the projectile spreads out so that its diameter is increased for when it strikes against a soft material such as a human body. If, on the other hand, the projectile is expected to first strike a harder object, for example a sheet metal wall, the projectile can be manually configured prior firing so that it will not spread and instead pass through the metal. A primary disadvantage of U.S. Pat. No. 4,136,616 is that it is totally ill-suited for use in law enforcement scenarios where the peace officer would be required to make the adjustment in near total darkness, with 3 seconds warning or less, in order to strike an assailant 3 to 20 feet away, and with at best imperfect information about the target details. Under life-or-death conditions, it is unrealistic to expect the operator to adjust the projectile before firing.

Another example may be found in U.S. Pat. No. 1,134,797 to Wood. This patent describes an expanding bullet which, on striking the skin of the game or other object, due to the resistance encountered, the head of the bullet will be suddenly checked in its velocity, and the momentum of the body will cause the same to be driven forward on the conical body of the expanding core to thereby force the same forwardly. As the bullet proceeds through the soft tissues, its head will be expanded in proportion to the resistance offered and will consequently result in the further and proportional expansion of the body. This design maximizes rather than minimizes internal tissue damage, and neither maximizes shallow wounds nor selectively penetrates auto windshields or other hard targets.

A still further example is depicted in US Publication No. 2015/0308800 to Schnabel. This patent document offers a highly schematic/superficial description of a multi-part expanding projectile.

Despite these numerous attempts to perfect the concept of an expanding projectile, none as yet have been successful to satisfy the needs of the law enforcement community nor of self-defense interest groups, both of whom are mindful that most confrontational situations that would provoke them to unholster a firearm and aim at threatening human being will arise in near total darkness, with 3 seconds warning or less, and the assailant will be located 3 to 20 feet away.

BRIEF SUMMARY OF THE INVENTION

According to one aspect of this invention, a projectile is provided of the type to be propelled through air. The projectile is specially constructed for lateral expansion only upon impact with a sufficiently soft target. The projectile comprises an annular submunitions array comprised of a plurality of discrete submunition elements. Each submunition element has an interior wedge surface defined by a portion of an interior funnel shape. A spreader is operatively disposed within the submunitions array. The spreader has a flared ramp that is adapted to engage the interior wedge surfaces of the submunitions. A ballistic penetrator is operatively disposed over the spreader. A pressure-sensitive link is disposed between the ballistic penetrator and the spreader. The pressure-sensitive link is responsive to a predetermined threshold impact force so as to disable the spreader when the impact force on the ballistic penetrator is above the predetermined threshold and thereby inhibit lateral expansion of the submunitions array.

The pressure-sensitive link facilitates the long-desired attribute of a projectile that capable of elective expansion characteristics. In particulate, the pressure-sensitive link does not disable the spreader when sufficiently soft targets are impacted, thus allowing the spreader to deploy the submunition elements. However, when the projectile strikes a hard object, such as an obstacle located in front of an assailant, the pressure-sensitive link reacts by disabling the spreader. As a direct result, the submunition elements are not deployed, allowing the projectile to maintain an essentially unitary or monolithic character with mass and penetrating power to pass through the obstruction along its continued trajectory toward the assailant.

BRIEF DESCRIPTION OF THE SEVERAL VIEWS OF THE DRAWINGS

These and other features and advantages of the present invention will become more readily appreciated when considered in connection with the following detailed description and appended drawings, wherein:

FIGS. 8A-E are sequential images showing the projectile in cross-section as it reacts to impact with a relatively hard object such as a vehicular windshield or sheet metal automotive body panel.

DETAILED DESCRIPTION OF THE INVENTION

Figure 1A:
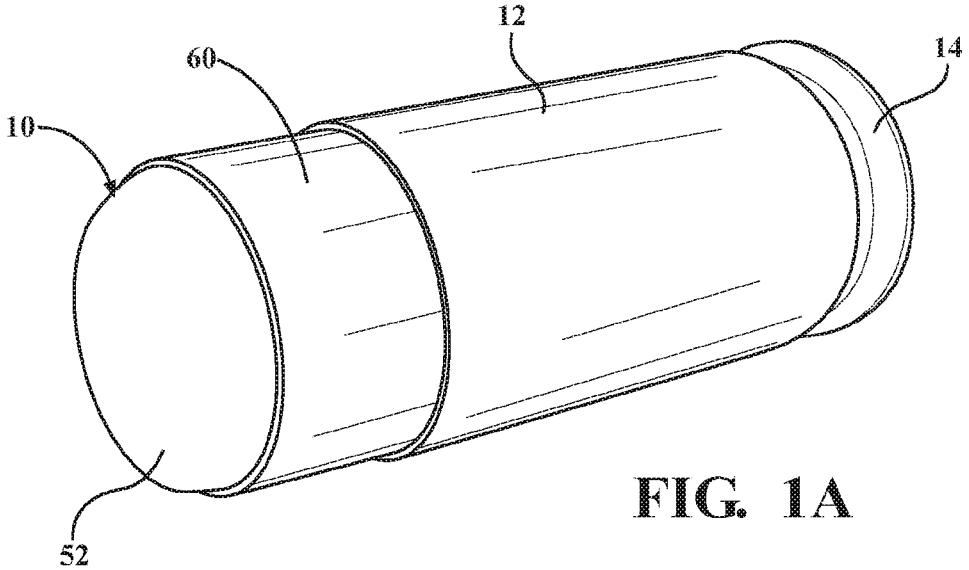
FIG. 1A is a perspective view of an un-fired round of ammunition including a projectile formed according to one exemplary embodiment of this invention.
Figure 1B:
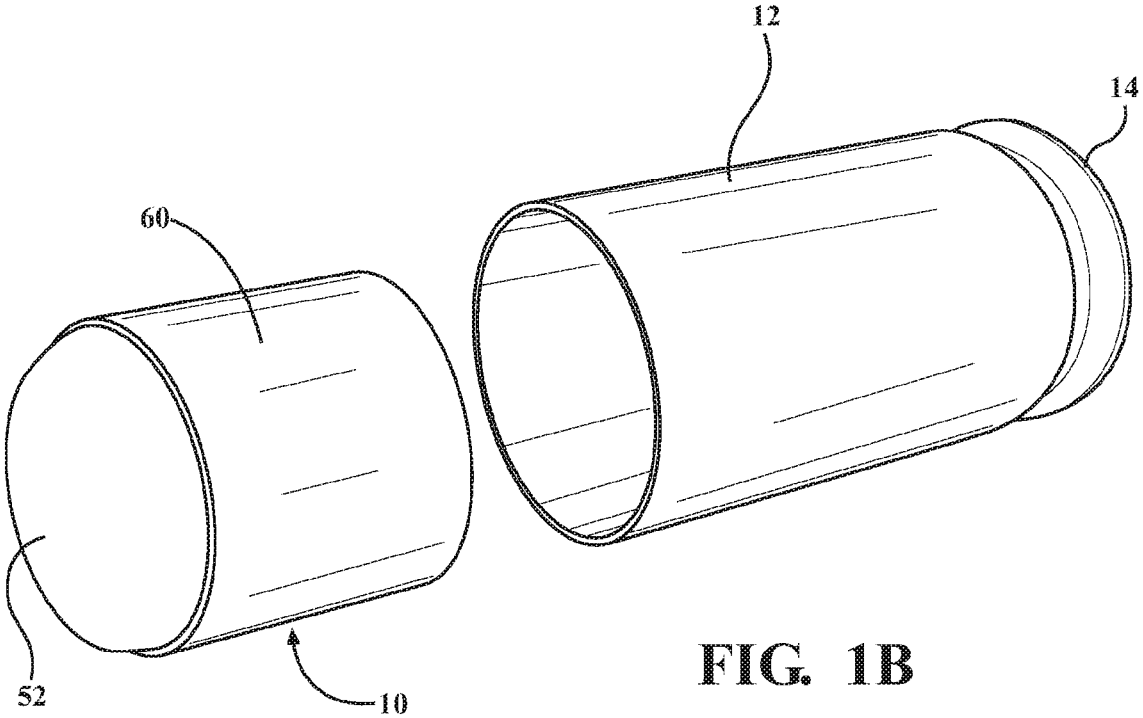
FIG. 1B is a view as in FIG. 1A showing the projectile separated from its casing as if just fired.

Referring to the figures, wherein like numerals indicate like or corresponding parts throughout the several views, a projectile according to one embodiment of the present invention is generally shown at 10. The projectile 10 is intended for small arms fire, also known as light firearm ammunition. In FIG. 1A, the projectile 10 is shown seated within the mouth of a shell casing 12. The shell casing 12 may be of any suitable type for containing a propellant, such as gunpowder. In FIGS. 1A and 1B, the shell casing 12 is shown in the form of a common center-fire type with the typical extractor rim 14 at its base. However, it is foreseeable that the projectile 10 could be used without the shell casing 12 such as in air rifle applications, electromagnetic (railgun) applications, muzzle (or breach) loading applications, and the like. It is also foreseeable that the projectile 10 could be used in sabot applications. Furthermore, although the accompanying illustrations might seem to suggest ammunition for handgun uses, and it would be accurate to say that handgun uses do form a primary and substantial intended application for the present invention, it must be understood that the teachings of this invention are not strictly limited to handgun ammunitions.

In these broader contexts, it is intended that the projectile 10 of this invention be understood to comprise any bullet-like or pellet-like element for use in firearms to be propelled by any means through the air at a target. And more particularly, as will be explained in detail, the projectile 10 is specially constructed for rapid and substantial lateral expansion upon impact with a sufficiently soft target (like a human body) but to resist expansion upon impact with a sufficiently hard intermediate obstruction (like glass or sheet metal). By rapidly expanding upon impact with a sufficiently soft target like a human body, the depth of penetration will be minimized and the transfer of energy to a wide, shallow area of the target will be maximized. In contrast, by resisting expansion upon impact with a sufficiently hard intermediate obstruction like a vehicular windshield, penetration will be maximized and the transfer of energy to the target will be minimized thus facilitating pass-through to an ultimate target further along the trajectory.

Figure 2:
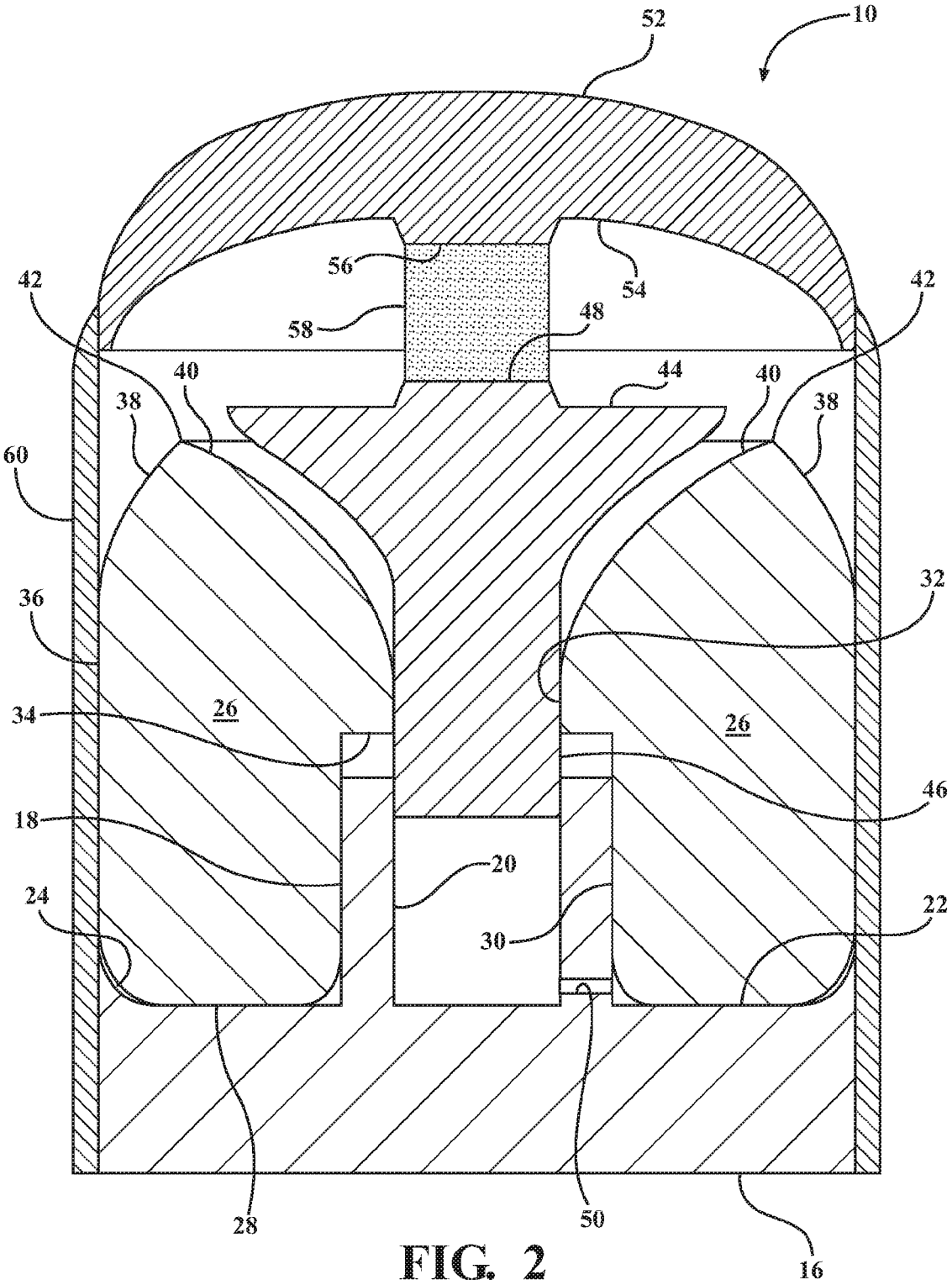
FIG. 2 is a cross-sectional view of the projectile of FIGS. 1A-B.
Figure 3:
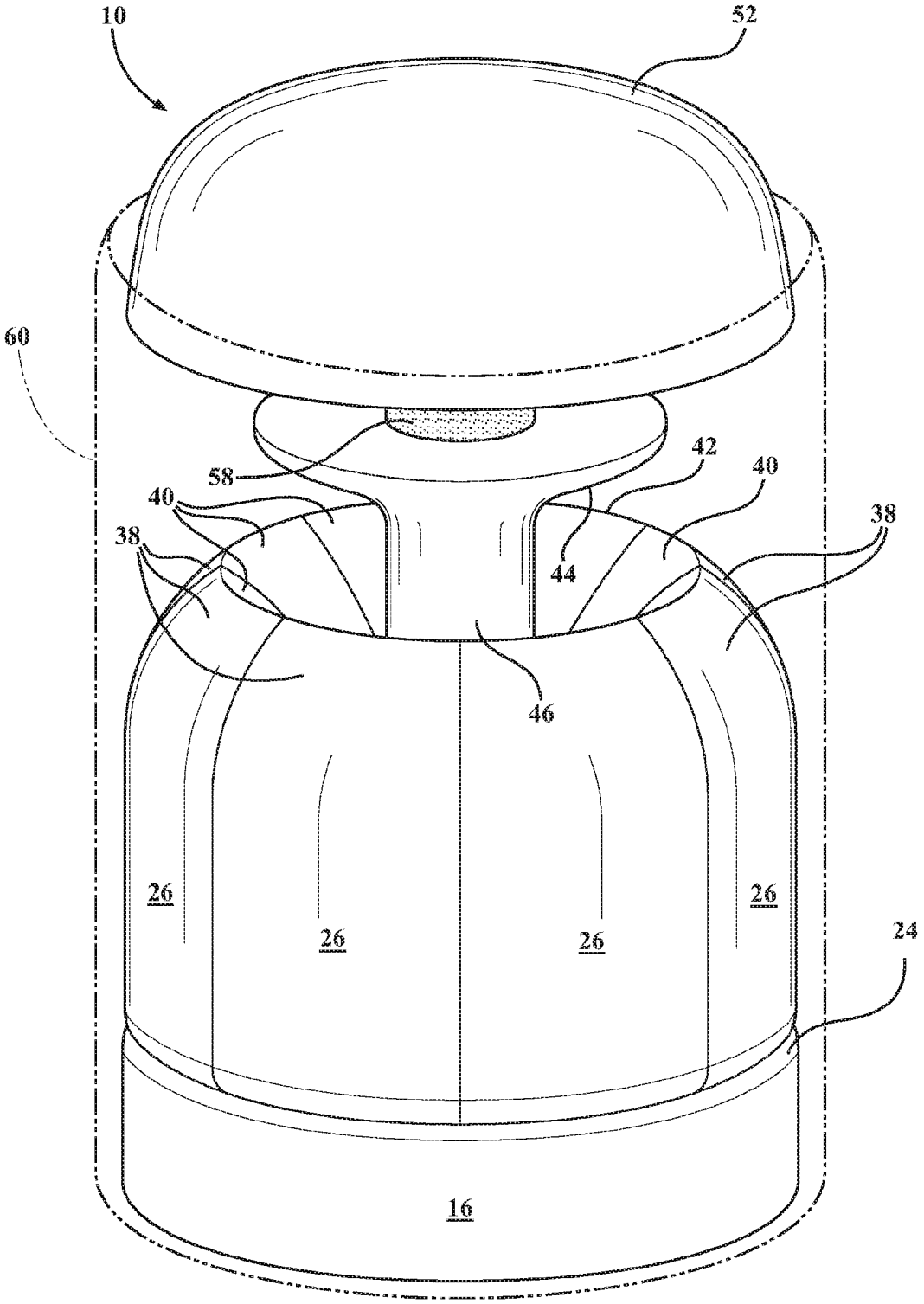
FIG. 3 is a perspective view of the projectile of FIG. 2 except that the jacket is depicted in phantom to better reveal the internal components.

Turning now to FIGS. 2 and 3, detailed images of the projectile 10 are shown according to an exemplary embodiment of the invention. As can be seen in these views, the projectile 10 includes a base 16 having a generally circular or cylindrical periphery. The base 16 may be made from any suitable, structurally strong and preferably dense material such as copper or brass or steel to name but a few options. The bottom surface of the base 16 may be flat as depicted or shaped to achieve any suitable purpose. The top surface of the base 16 includes a guide 18. The guide 18 may be located concentrically with respect to the circular periphery of the base 16 to maintain rotational balance when fired through a barrel with rifling. Although the actual shape of the guide 18 is highly variable according to the dictates of a designer's intent, the guide 18 shown in the figures is cup-like having a generally cylindrical outer sidewall and a generally cylindrical inner sidewall. The inner sidewall forms a socket 20. On the top surface of the base 16, the annular region surrounding the guide 18 comprises a platform 22. The platform 22 is thus the portion of the top surface of the base 16 disposed between the outer sidewall of the guide 18 and the extreme circular or cylindrical periphery of the base 16. In some contemplated embodiments the platform 22 may be flat. However, in the illustrated examples the platform 22 has a concave shape defined by an outer annular fillet 24 for purposes that will become apparent. The annular fillet 24 may take the form of an upwardly turned lip having a smooth inside radius of curvature.

A submunitions array is disposed upon the platform 22 of the base 16, encircling the guide 18. The submunitions array is comprised of a plurality of discrete submunition elements 26 arranged like sectors of a circle or wedge slices of a tangerine fruit around the base 16. The number of submunitions elements 26 within the array is variable. The illustrated examples variously show seven, eight and/or nine discrete submunition elements 26. However, the projectile 10 may be designed with as few as two submunitions elements 26 or as many as desired. To facilitate emergency care, it may be desirable to configure the array with a logical number of submunition elements 26, for example eight pieces. Submunitions arrays comprised of four-to-twelve discrete submunition elements 26 are generally considered adequate for most foreseeable applications. The submunition elements 26 may be made from any suitable material, including but not limited to alloys of tungsten, copper, steel and other materials both metallic and non-metallic.

Each submunition element 26 has a foot 28 disposed in direct surface contact with the platform 22. The foot 28 may be optimally shaped with a rounded outer corner matched, or generally matched, to the curvature of the annular fillet 24 so as to loosely form a pivoting joint. That is to say, the annular fillet 24 may be designed to function something like a pad or knuckle in pressing contact with the foot 28 of each submunition element 26 to encourage each submunition element 26 to individually pivot when forced to fan out like flower petals as depicted in FIGS. 5A-E.

Returning to the cross-sectional view of FIG. 2, each submunition element 26 is seen to include a lower locator surface 30 extending upwardly from the foot 28 and disposed to engage the outer sidewall of the guide 18. The lower locator surface 30 may be shaped with a cylindrically concave curvature to generally compliment the cylindrical outer sidewall of the guide 18. Advantages of shaping the lower locator surface 30 with a curvature to compliment the guide 18 include more efficient component packaging which translates into less shifting in flight, better control over rotational balance, and mass maximization. Each submunition element 26 also includes an upper locator surface 32 disposed above the lower locator surface 30. In the illustrated examples, the upper locator surface 32 partially overhangs the guide 18 of the base 16, such that a small ledge or soffit 34 is formed directly over the guide 16. The upper locator surface 32 may, optionally, be cylindrically concave to generally match the cylindrical inner sidewall of the guide 18 (or more specifically to match a shaft 46 to be introduced subsequently).

Each submunition element 26 has a back surface 36 that extends upwardly from the rounded outer corner of the foot 28. As perhaps best seen in FIG. 2, the back surface 36 has a generally convex curvature that matches the circular/cylindrical periphery of the base 16. When all of the submunition elements 26 are arranged in the array, the combined back surfaces 36 form a full cylindrical shape that closely aligns with the circular/cylindrical periphery of the base 16.

Returning once again to FIG. 2, each submunition element 26 is shown having a top or leading end opposite the foot 28 thereof. The leading end is specially shaped to accomplish the purposes of this invention. In particular, the leading end of each submunition element 26 has a radially outer interlock portion 38 and a radially inner wedge surface 40. A peaked, ridge-like leading edge 42 delineates the interlock portion 38 from the wedge surface 40. The interlock portion 38 extends on the outside from the back surface 36 to the leading edge 42, whereas the wedge surface 40 extends on the inside from the upper locator surface 32 to the leading edge 42.

The interlock portion 38 is designed to have a predetermined positive geometric shape. The predetermined positive geometric shape can take many different forms, the details of which are largely subject to designer's choice. In the illustrated examples, the positive geometric shape of the interlock portion 38 is depicted as a simple convex curvature. When all of the submunition elements 26 are arranged in the array, the combined interlock portions 38 form a semi-spherical shape. As said, however, in practice a great many geometric variations are possible. For example, in another contemplated embodiment (not shown), the positive geometric shape of the interlock portion 38 takes the form of a terraced or stair-stepped configuration. In yet another contemplated example (also not shown), the positive geometric shape of the interlock portion 38 takes the form of one or more grooves and/or ridges. Indeed, many geometric shaped are possible provided there is at least one outwardly-facing surface against which pressure can be applied to resist the submunition element 26 from being allowed to fan out like flower petals.

As perhaps best seen by alternately comparing FIGS. 2 and 3, the wedge surface 40 has a curvature that forms a portion of an interior funnel shape. That is, the wedge surface 40 slopes between the leading edge 42 and the upper locator surface 30. When all of the submunition elements 26 are arranged in the array, the combined wedge surfaces 40 form a generally conical or hyperbolic funnel-like shape. The exact curvature of the wedge surface 40 can be optimized using the principles of sliding cam design.

A spreader 44 is positioned centrally within, or otherwise poised to engage, the submunitions array. The lower end of the spreader 44 may be configured as a shaft 46 that is received inside the socket of the guide 18 with sufficient running clearance to enable smooth axial sliding movement therebetween. In other words, the shaft 46 of the spreader 44 fits inside the socket 20 of the guide 18 with sufficient clearance/tolerance so that the spreader 44 is constrained laterally but is free to move axially. The upper locator surfaces 32 of the submunition elements 26 are configured to rest against the shaft 46, as shown in FIG. 2. Notably, the spreader 44 has a flared ramp that is adapted to simultaneously engage the wedge surfaces 40 of each submunition element 26 with cam-like action to fan them out as depicted in FIGS. 5A-E. The spreader 44 may be formed with a well-defined anvil 48 on its uppermost surface, i.e., opposite the shaft 46. The anvil 48 is adapted to receive an impact force that will drive the spreader 44 toward the base 16. The anvil 48 can take any suitable shape, and even be omitted as a distinctive feature of the spreader 44. However, in the illustrated examples, the anvil 48 takes the form of a plateau having a generally circular shape.

Optionally, the projectile 10 may be designed to include a vent 50 to allow the escape of air or other gas or filler medium from the socket 20 when the shaft 46 of the spreader 44 descends. The vent 50 is shown in FIG. 2 as a small hole disposed in the guide 18, however this is merely intended to represent any possible venting configuration that may be deemed suitable. In another contemplated example (not shown), the hole in the guide 18 is omitted in favor of a splined shaft 46 to facilitate the egress of trapped air or other gas or filler medium from the socket 20. Indeed, many venting options are possible and may not even be needed in all applications.

The nose of the projectile 10 comprises a ballistic penetrator 52. The ballistic penetrator 52 is operatively disposed over the spreader 44, as shown in FIG. 2, and is adapted to transmit an impact force to the spreader 44 via its the anvil 48 (or other feature if there is no anvil). The outer or exposed leading face of the ballistic penetrator 52 can take any suitable shape. A round nose (flattened dome) shape is shown in the accompanying illustrations, but this can be changed to any desired shape including but not limited to flat nose, wadcutter, semi-wadcutter and even spitzer. Also not shown but fully contemplated for the leading face of the ballistic penetrator 52 are hollow-point features, tungsten carbide tips, full metal jackets, soft point tips, and the like. The leading face of the ballistic penetrator 52 may be defined by a circular outer edge whose diameter generally matches or aligns with the circular periphery of the base 16.

For convenience, the underside of the ballistic penetrator 52, i.e., opposite the leading face, may be designated the sheltered face 54. At least a portion of the sheltered face 54 will have a predetermined negative geometric shape that compliments the positive geometric shape of the interlock portions 38. Or said another way, a mating or nested or somewhat puzzle-piece like fit is established between the sheltered face 54 and the interlock portions 38 of the submunitions array, especially adjacent the outside edge of the ballistic penetrator 52. In the illustrated examples where the interlock portions 38 are convexly curved, the negative geometric shape of the sheltered face 54 will be defined by a concave curvature so that the parts have the ability to matingly engage. In the other mentioned examples of positive geometric shapes for the interlock portions 38 in the forms of terraces, stair-steps, grooves and ridges, the sheltered face 54 will take an adaptive configuration so that when (if) the ballistic penetrator 52 is brought into direct contact with the submunitions array, a tight nesting fit will be established. And more preferably still, the nesting fit may actually apply a radially inward force on the submunition elements 52 so that they are more tightly compressed together by the impact forces.

The sheltered face 54 of the ballistic penetrator 52 may be fitted with a centrally located ram 56. The ram 56 directly opposes the anvil 48 of the spreader 44. And, like the anvil 48, the ram 56 may also be configured like a plateau having a generally circular shape. In other contemplated embodiments, one or both of the anvil 48 and ram 56 are formed as depressions.

The adaptive qualities of the projectile 10 are enabled by at least one pressure-sensitive link 58 operatively disposed between the ballistic penetrator 52 and the spreader 44. In the illustrated examples, a single pressure-sensitive link 58 extends between the ram 56 and the anvil 48 like a cylindrical bridge or column that physically couples the ballistic penetrator 52 to the spreader 44 so that impact forces visited upon the ballistic penetrator 52 are directly transmitted to the spreader 44. As stated previously, one or both of the anvil 48 and ram 56 may alternatively be formed as depressions that offer self-centering benefits for the pressure-sensitive link 58.

In other contemplated embodiments the pressure-sensitive link 58 can take the form of one or more shear pins or springs or other frangible elements. Regardless of the specific design implementation, it is expected that impact forces up to a predetermined threshold will result in concerted movement of the ballistic penetrator 52 and spreader 44 as a unitary structure. That is to say, impact forces below the predetermined threshold will cause in the spreader 44 to move (axially) with the ballistic penetrator 52 in a 1:1 ratio.

The predetermined threshold can be controlled at the time of design by varying the compositional and/or dimensional attributes of the pressure-sensitive link 58. However, in most contemplated applications the predetermined threshold will be chosen to correspond to the average impact force generated through the deceleration of the projectile 10 in flesh or ballistic gelatin, possibly with a layer of material resembling common outer garments such as a jacket or sweater, for a given diameter, mass and velocity of the projectile 10. And, the predetermined threshold must be high enough to survive the anticipated G-forces at firing. As an example, assuming a projectile 10 configured to be fired from a standard 9 mm handgun (i.e., a 9×19P round), with a weight in the range of about 115-124 grains, traveling at a velocity in the neighborhood of ~900-1300 ft/sec, the deceleration to be expected upon impact with flesh or ballistic gelatin may be about 30,000 Gs. The Gs experienced upon firing in this example, can be estimated about 50,000 Gs.

The predetermined threshold impact force for an adaptive projectile 10 configured for this application must therefore be reliably greater than 50,000 Gs (i.e., the greater of firing acceleration and soft impact deceleration) so there is little-to-no risk of exceeding the predetermined threshold when impacting a soft target. It may, in this circumstance, be desirable to design the pressure-sensitive link 58 so that its predetermined threshold impact force is reached at deceleration rates in the range of about 60,000-90,000 Gs (i.e., 2-3 times the actual expected deceleration rate in flesh). This safety factor will account for thick clothing or outer garments worn by the target attacker.

A generally cylindrical jacket 60 encloses the submunitions array and the spreader 44 to retain all of the components of the projectile 10 together in a tight pack. The jacket 60 is preferably friction-fit or crimped about the circular periphery of the base 16 and also friction-fit or crimped about the outer edge of the ballistic penetrator 52. In some contemplated designs, the jacket is seated on a ledge formed about the outer periphery of the base 16 to provide better structural integrity. The jacket 60 is preferably fabricated from a malleable metallic material, such as copper, to readily interact with the rifling in the barrel of a firearm from which it may be fired. An uppermost edge of the jacket 60, adjacent the ballistic penetrator 52, is preferably rounded or chamfered to eliminate a bur and facilitate transit through the firearm barrel. As shown in FIG. 1A, the jacket 60 may optionally include one or more stress-concentrators, such as score lines, to encourage fragmenting upon impact with a sufficiently soft target (i.e., below the predetermined threshold impact force).

Figure 4B:
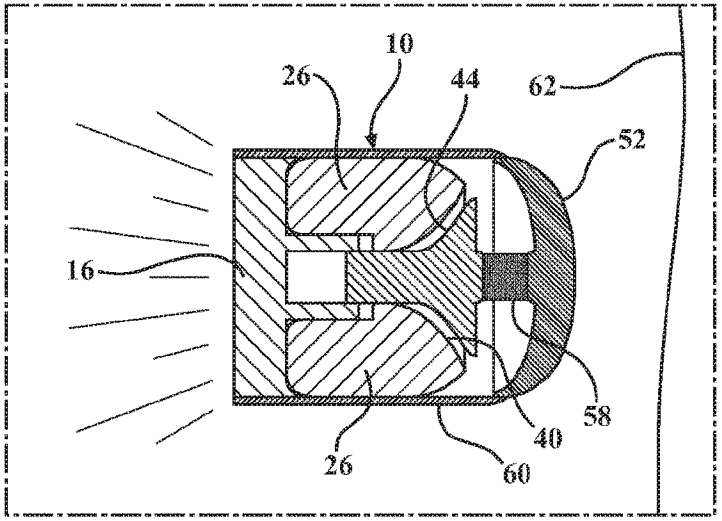
FIG. 4B is an enlarged view of the area indicated at 4B in FIG. 4A showing the projectile in cross-section and prior to impact.
Figure 4A:
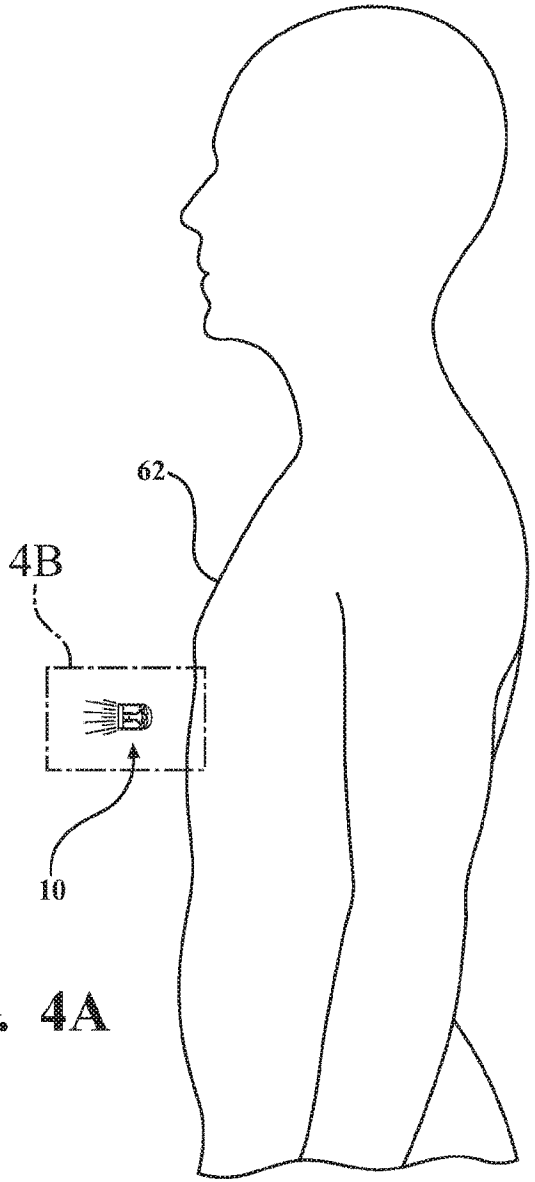
FIG. 4A is a highly simplified view showing a projectile according to one exemplary embodiment of this invention in flight at the moment prior to impact with the torso of a human target.

FIG. 4A shows a projectile 10 at the moment before impacting the torso 62 of a human target in the context of a proper police or self-defense action. FIG. 4B is an enlarged view of the detail area indicated at 4B in FIG. 4A and shows the projectile 10 in cross-section at the moment before impact. FIG. 4C is a further progression showing the projectile 10 at the moment of impact with the assailant's flesh 62. The ballistic tip 52 begins to decelerate at a slow enough rate (e.g., ~30,000 Gs using the preceding example) that the impact forces remain below the predetermined threshold for the pressure-sensitive link 58. As a result, axial forces transmitted through the pressure-sensitive link 58 drive the spreader 44 into the center of the submunitions array. The flared ramp portion of the spreader 44 engages the wedge surfaces 40 of each submunition element 26 with cam-like action, causing them to fan out. In these initial moments, the rounded corners on the foot 28 of each submunition element 26 are caught by the annular fillet 24 on the base 16, thus encouraging each element 26 to pivot outwardly. The forceful spreading of the submunition elements 26 causes the jacket 60 to fragment apart as well, perhaps aided by one or more stress-concentrating features.

Figure 4D:
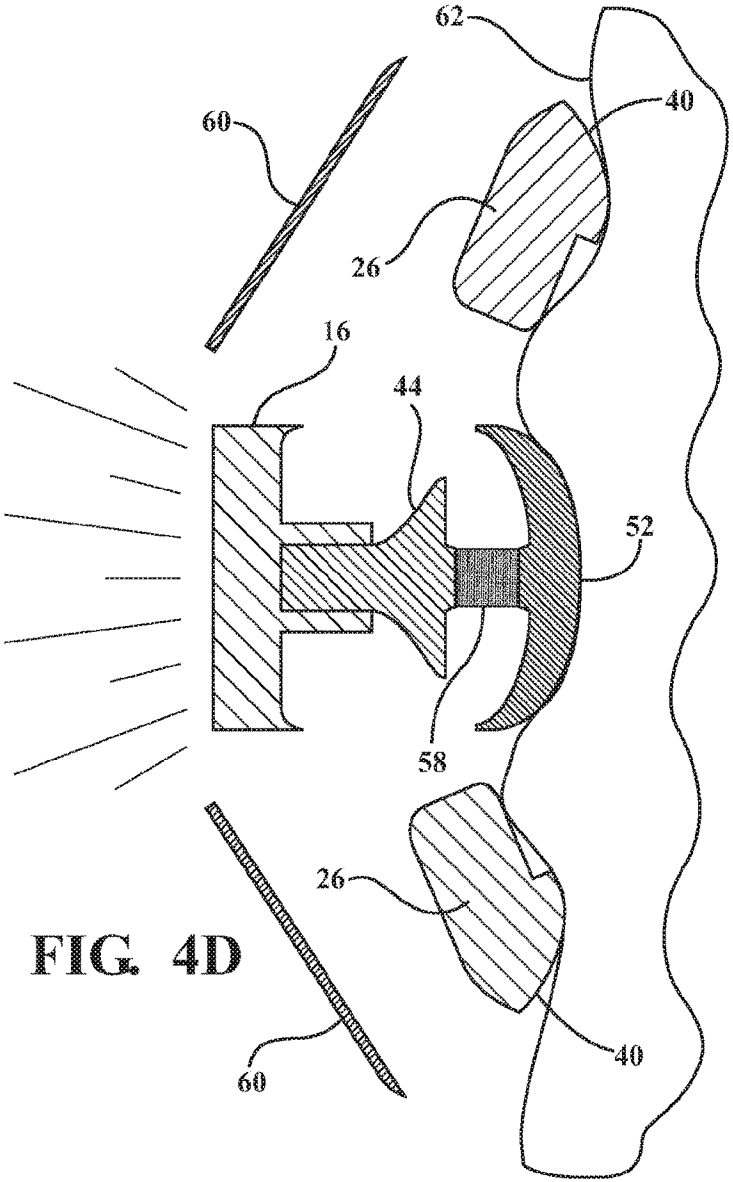
FIG. 4D is a view as in FIG. 4C showing a still further progression of the projectile in cross-section and impacting the human torso.
Figure 4C:
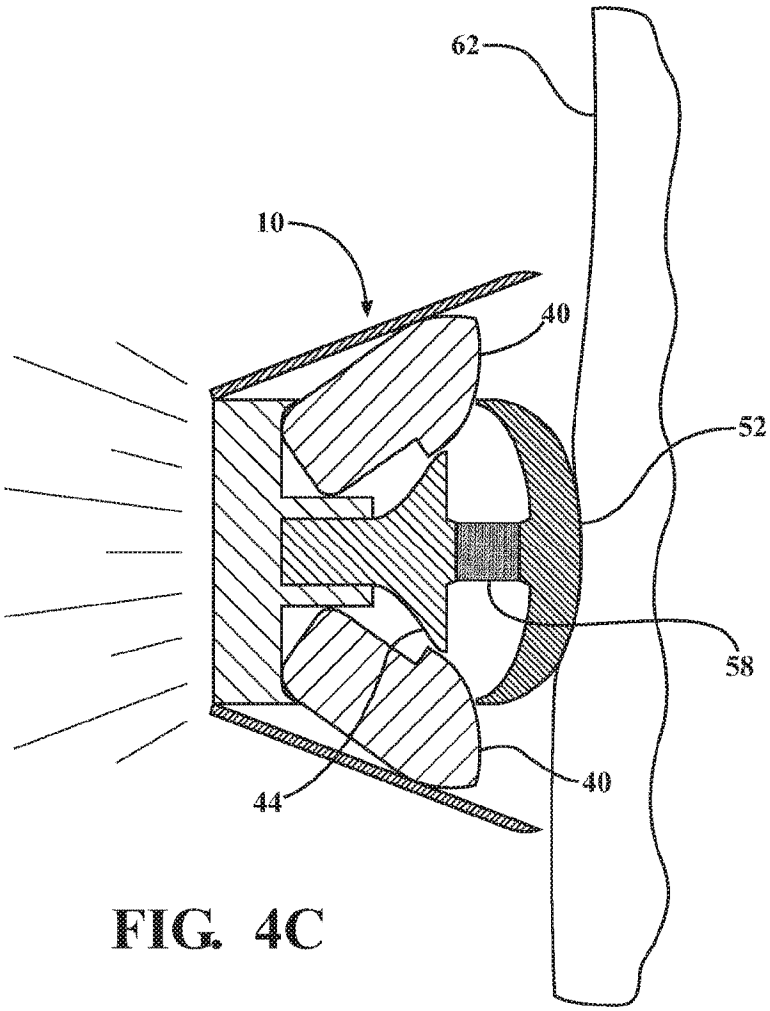
FIG. 4C is a view as in FIG. 4B showing a further progression of the projectile in flight at the moment of impact against the torso of a human target.
Figure 5A:
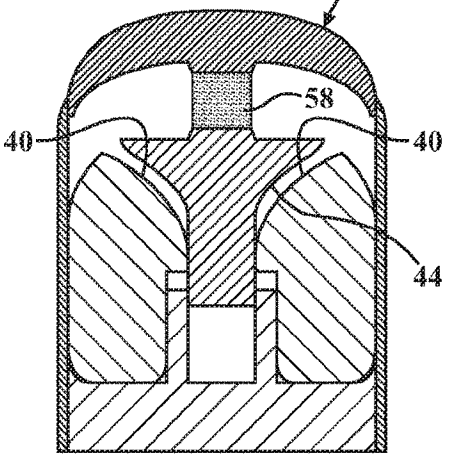
FIGS. 5A-E are sequential images showing the projectile in cross-section as it expands due to impact with a relatively soft object such as the flesh of an assailant.
Figure 5B:
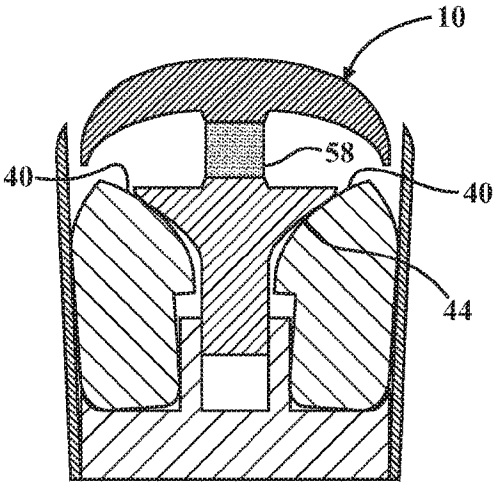
Figure 5C:
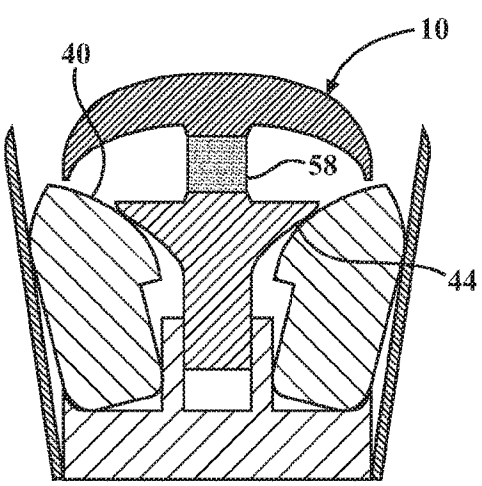
Figure 5D:
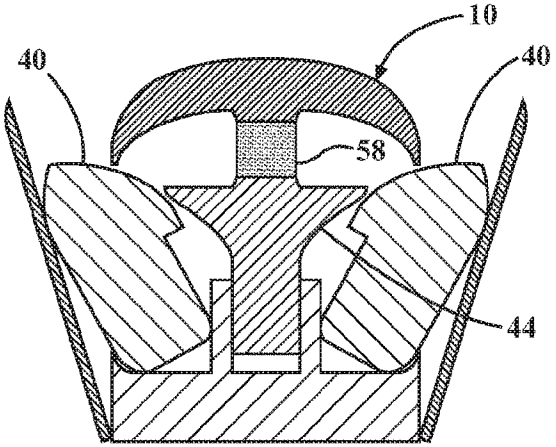
Figure 5E:
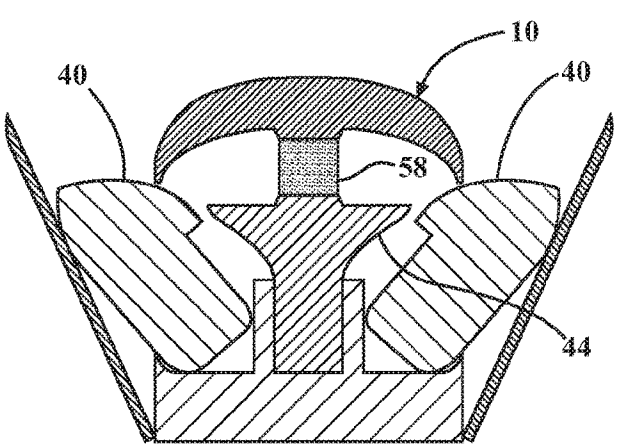

FIG. 4D shows a still further progression from FIG. 4C, with continued expansion and separation of the submunition elements 26 and the jacket 60, thus inflicting a substantial and wide-spread surface injury with very minimal penetration into vital organs. All of the kinetic energy and momentum of the projectile 10 are distributed over a large surface area of the human target, with lacerating and extremely painful, but typically non-lethal effect.

Figure 6:
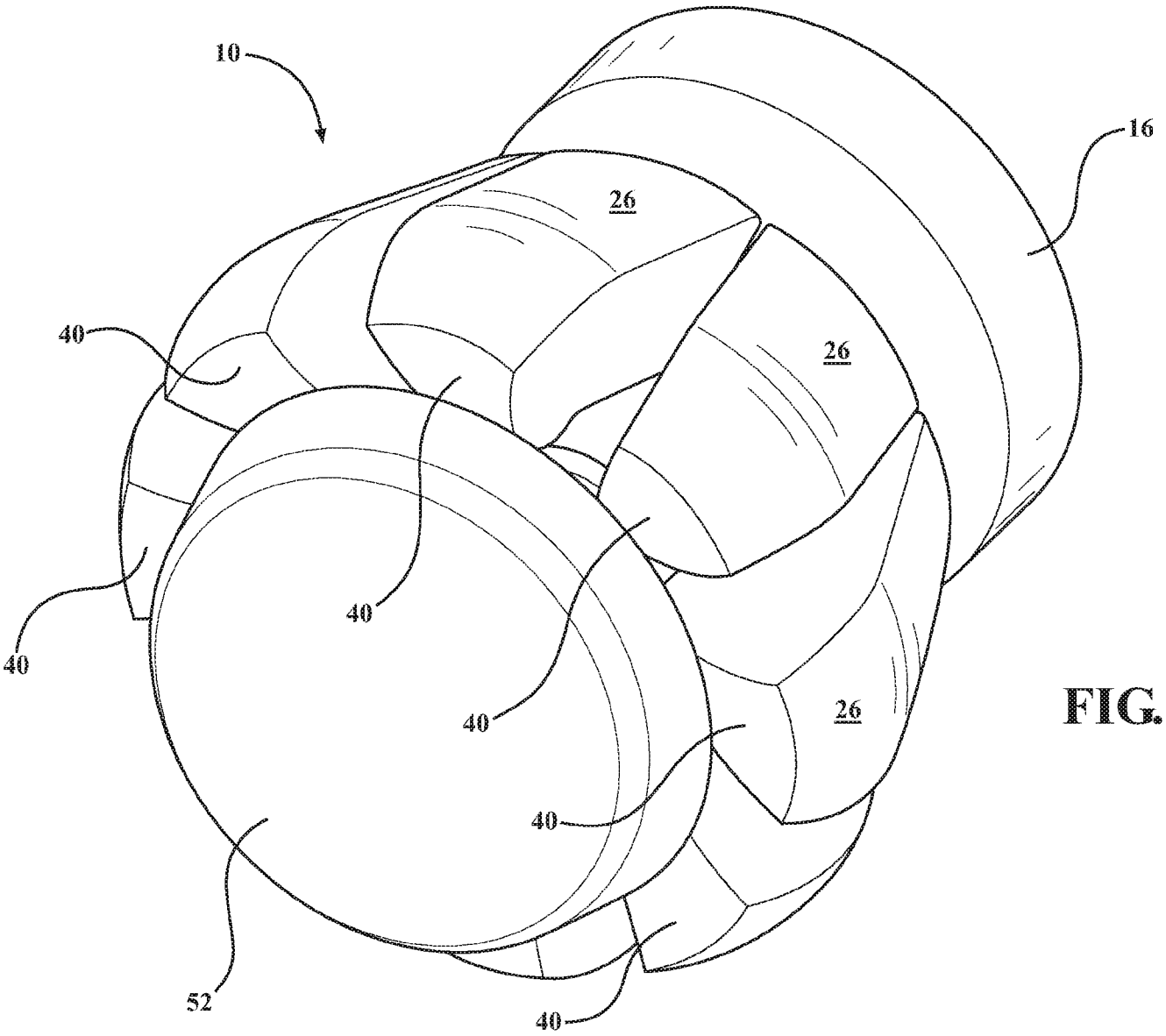
FIG. 6 is a perspective view of a without the jacket projectile (as in FIG. 3) and with the submunitions elements partially deployed to a position generally corresponding to FIG. 5D.
Figure 7:
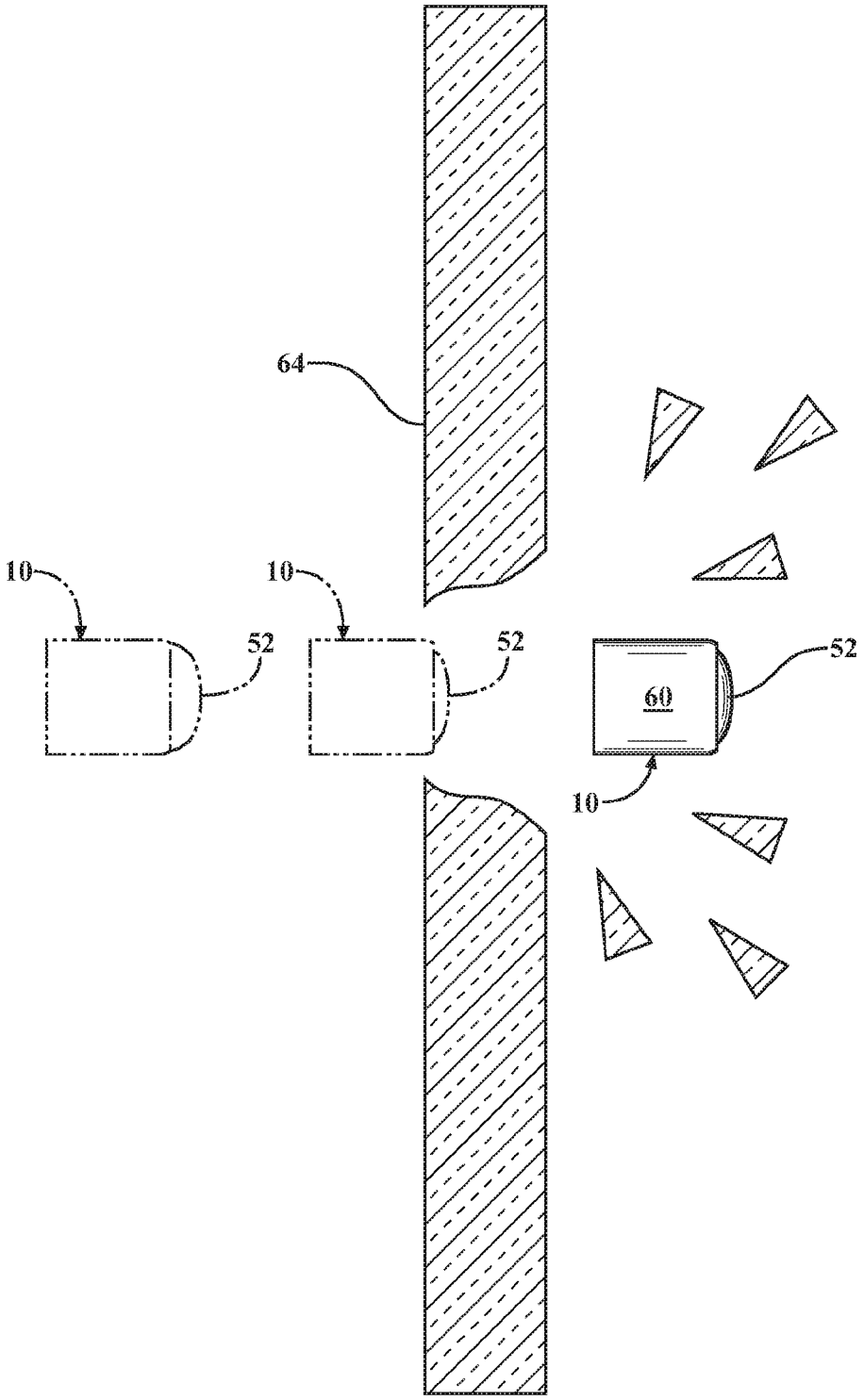
FIG. 7 is a view showing the projectile passing through an intermediate hard object such as a vehicular windshield.

FIGS. 5A-E depict the progressive expansion of the projectile 10 upon impact with a soft target 62. These views, arranged in side-by-side format, will help describe the concerted/unitary movement of ballistic penetrator 52 and spreader 44 in situations where a soft target 62 generates an impact force below the predetermined threshold of the pressure sensitive link. FIG. 6 is a perspective view of the projectile 10 without the jacket 60 that generally corresponds to FIG. 5C. In this view, the spreader 44 has just begun to displace the submunitions elements 26. Each submunitions element 26 is seen to be pivoting on the base 16 about its rounded corner due to the annular fillet 24.

FIGS. 7 and 8A-E represent the behavior of the projectile 10 when contacting a hard intermediate obstruction such as a vehicular windshield 64 or sheet metal panel behind which the assailant is located. In the preceding example of a projectile 10 configured to be fired from a standard 9 mm handgun, with a weight in the range of about 115-124 grains and traveling at a velocity in the neighborhood of ~900-1300 ft/sec, the deceleration to be expected upon impact with a typical vehicular windshield 64 may be about 150,000 Gs. Assuming the pressure-sensitive link 58 is designed so that its predetermined threshold impact force is reached at deceleration rates in the range of about 60,000-90,000 Gs, it can be reliably expected that upon experiencing a deceleration of about 150,000 Gs, the predetermined threshold impact force will be exceeded. Under these conditions, the pressure-sensitive link 58 is responsive to permit relative axial movement between the ballistic penetrator 52 and the spreader 44. That is to say, when the predetermined threshold impact force is exceeded, the spreader 44 is disabled by catastrophic collapse of the pressure-sensitive link 58, thereby preventing lateral expansion of the submunitions array. Movement of ballistic penetrator 52 allows its sheltered face 54 to descend into encircling contact with the interlock portions 38 of the submunitions array, thereby retaining the submunition elements 26 as a penetrating unit capable of passing through the hard intermediate obstruction 64 to continue its trajectory toward a down-range ultimate target (e.g., an assailant located behind a windshield 64).

Naturally, the design and composition of the pressure-sensitive link 58 is critical to proper operation of the projectile 10. As one example, the pressure-sensitive link 58 is fashioned in the form of a cylindrical column and fabricated from a material having a shatter strength of the order of 350,000 psi. More generally, the pressure-sensitive link 58 may be designed to achieve fracturing parameters between 320,000 psi and 400,000 psi, where the parameter is driven by the dimensions of the pressure-sensitive link. Certain spinel crystal structures have been found to satisfy these design criteria, including but not limited to Aluminum Oxynitride [ALON] spinels marketed by Surmet Corporation, which have compressive strengths of 2.68 GPa [≈389,000 psi].

Materials other than crystallographic spinels may also be found suitable for the pressure-sensitive link 58, provided they exhibit a shattering behavior and dimensional compatibility with the applicable bullet geometries and force magnitudes. Such alternatives may include synthetic spinel, sapphire, corundum, the multiple carbide and nitride families, as well as some exotic materials. Use of a non-metallic material for the pressure-sensitive link 58 may be considered preferable to ensure near-instantaneous decoupling of the ballistic penetrator 52 from the spreader 44, so that the submunition elements 26 might have zero radial force transmitted to them.

As stated, the anvil 48 and ram 56 could easily be configured so that the interconnecting pressure-sensitive link 58 operates in shear mode rather than compression. Shear pins are well-known for use to prevent a mechanical device from operating before the criteria for operation are met. Shear pins are typically cheap, easy to produce, maintenance-free and can remain ready for operation for years with little to no decrease in reliability.

In order to encourage ready adoption by relevant law enforcement and self-defense communities, it is desirable that the projectile 10 be designed to exhibit aerodynamics, moment of inertia, total mass, and center of gravity closely matching those of the common commercial rounds to be replaced. For handgun applications, these will naturally include the 9 mm, 38 Special/.357 Magnum, 40 cal. and 45 cal. Close matching of specifications for comparable commercial rounds will enable range practice with regular commercial loads. Use of ammunition fitted with the projectile 10 can be limited to on-the-job use in cases of actual assailant situations.

The premise behind the efficacy of the projectile 10 is that in some situations stopping an assailant can be accomplished by producing a large (~1 $ft^2$.) surface wound using multiple submunition elements 26 originally constituted as a unitary bullet. Upon impact with a soft target 62, the submunitions 62 fly away from one another at as close to a 90-degree angle to the initial trajectory as possible. Preferably, but not necessarily, the submunitions 62 projectiles are dense, non-toxic, non-fragmenting, easy to see with X-rays during medical treatment, not excessively sharp (to protect medical personnel) and occur in a logical number, for example eight pieces, to facilitate emergency care. The wounds they produce should be as painful as possible, in order to stop a would-be attacker with a single shot, if possible, but should not penetrate deeply enough to damage bone, internal organs, nerves, or critical blood vessels.

Stopping an assailant situated behind an obstruction is a different matter altogether. These types of situations require that the projectile 10 remain intact as it passes through the obstruction and continue its trajectory to reach the assailant. For example, the assailant may be in the act of piloting a motor vehicle in a threatening manner, and the obstruction could be the glass windshield or door glass 64, sheet metal and/or plastic door of the vehicle or its roof, etc. Such shots through obstructions may necessarily and unfortunately result in lethal impact to the assailant.

To summarize the foregoing, the invention is a projectile 10 that is specially constructed for lateral expansion upon impact with soft targets such as humans 62. But the projectile 10 is adaptive in that the lateral expansion depends on the hardness of the target in a way that is nominally the reverse of the simple behavior of common experience, in which the fractionation behavior of a projectile increases as impact force increases, rather than decreases. When impacting a relatively hard object, like a windshield 64 or sheet metal, the projectile 10 along with its submunition elements 26 retain a unitary geometry for maximum penetration. Penetration against hard objects is achieved through the use of a pressure sensitive-link 58 that structurally fails upon hard object impact, along with a ballistic penetrator nose cone 52 that slides backward as a part of the behavior of the pressure-sensitive link 58 and thereby retain the submunition elements 26 in a unitary bundle behind said nose cone. The result is a conventional ballistic penetrator that behaves in a conventional manner against a windshield 64 or other similar hard obstruction. In such cases, no lethality protection is afforded to a human target, and the projectile 10 responds to that human target in a conventional manner.

The adaptive projectile 10 includes a flat base 16 with a small, hollow cylinder (guide 18) attached to its top at its center. The role of the guide 18 is to stabilize a spreader 44, by allowing the spreader 44 to slide within the socket 20 of the guide 18. Surrounding the guide 18 are the plurality of rigid, preformed submunition elements 26. To envision their shape, it could be useful to imagine a soft, foam rubber children's football. The football is cut in half across its midsection, and a hole is drilled into it from both the top and the bottom, meeting in the middle. The bottom hole is cylindrical and sized to accommodate the outer cylinder part of the guide 18, and the top hole is smaller, but expands near the top, so that the hole itself resembles a golf tee or a small kitchen funnel in cross section. The resulting shape is sliced into identical (or regular alternating) pieces, from top to bottom, not unlike the identical pieces of a tangerine. Each piece is referred to as a submunition element 26. In one embodiment, the submunition elements 26 are made of tungsten, an extremely hard, tough, dense, x-ray opaque, nontoxic metal with specific gravity of 19.3.

Inserted into the upper hole between the centers of the submunition elements 26 is the spreader 44. The spreader 44 may be said to somewhat resemble a golf tee in cross section. Thus, its shape resembles the void in the submunitions array into which it is inserted.

Atop the entire assembly is the armor piercing penetrator 52, shaped somewhat like a bell or an umbrella in cross section, although the exact geometry of its upper surface could vary, depending on specific armor piercing requirements that might evolve. The interior diameter of the ballistic penetrator 52 is large enough to allow it to slip over the common tops (i.e., interlock portions 38) of the submunition elements 26.

The ballistic penetrator 52 is attached to the spreader 44 with a narrow pressure-sensitive link 58, made of a brittle material strong enough not to break during the forces encountered during firing and impact with a soft target, such as body tissue or clothing, but that would shatter during impact with a hard obstruction such as automotive glass.

The entire assembly is enclosed by a jacket 60 made of soft metal, for example, brass, allowing the assembly to conform to barrel rifling, and also holding it together until impact in the face of aerodynamic and centrifugal forces. The jacket 60 may or may not be scored to assist in fractionation or tearing as described below.

The projectile 10 is considered adaptive because it has two reactive modes of operation: soft target and hard obstacle. The projectile 10 is designed to react to hard obstacles differently than to soft targets. These terms are relative, where the term "soft target" refers to the human body, with or without normal layers of clothing, and where the term hard obstruction/obstacle refers to hard mechanical items such as automotive window glass, sheet metal, and possibly harder plastics.

In reacting to a soft target impact, the ballistic penetrator 52, the pressure-sensitive link 58, and the spreader 44 are pushed downward as a single unit, moving into the void inside the socket 20 on the base 16, which stabilizes the downward motion of the spreader 44 and prevents it from any motion other than straight downward. After traversing the optional void, which may be of zero volume or, if of non-zero volume may be filled with air or with either a lubricating material or other material with other useful properties, the lower surface of the spreader 44 contacts the wedge surface 40 of the plurality of single submunition elements 26. This contact occurs essentially simultaneously for all single submunition elements 26.

The impact of the spreader 44 causes the submunition elements 26 to individually rotate outward about their outside bottom corners (feet 28), constrained by the annular fillet 24. The jacket 60, which is very thin, deforms outward or begins to tear apart, potentially assisted by scoring. Further downward motion of the rigid combination of the ballistic penetrator 52, the pressure-sensitive link 58 and the spreader 44 may optionally cause the edge of bell-like ballistic penetrator 52 to further force the submunition elements 26 to individually rotate outward. The submunition elements 26 continue to rotate outward until the spreader 44 touches the bottom of the socket 20. At this time the submunition elements 26 have a mostly outward radial trajectory, having absorbed a significant portion of the total kinetic energy of the submunition element 26 as impact began. This causes them to fly sideways, potentially inducing significant, painful skin damage, but very little or no internal damage, since their trajectory at this time is largely radial.

The combination of the ballistic penetrator 52, the pressure-sensitive link 58, the spreader 44, the base 16 and the jacket 60 continue forward, but the expansion of the jacket 60 along with the loss of mass from the radial deployment of the submunition elements 26, greatly slows down this combination, resulting in very little kinetic energy being deposited into the body, very limited penetration, and very low likelihood of significant internal injuries. The non-toxic composition of the components, along with the extremely hard, tough materials used and the absence of sharp edges, as well as the x-ray opacity, causes the components to remain intact for simpler medical treatment.

In situations where the projectile 10 first encounters a hard obstacle, the ballistic penetrator 52 strikes with sufficient energy so as to cause the pressure-sensitive link 58, made of a brittle material with an appropriately chosen fracturing strength, a shear pin assembly, or other similar mechanism, to shatter without transferring appreciable kinetic energy to the spreader 44. The ballistic penetrator 52 descends onto the tops of the plurality of submunition elements 26 nearly simultaneously, causing the lower edge of the ballistic penetrator 52 to encircle the tops of the submunition elements 264, constraining them to remain together. The jacket 60 stays largely intact, since there exists no significant outward force to cause it to fracture. The now essentially unitary/monolithic projectile 10 continues, behaving as a hard, armor piercing bullet that will penetrate items of interest to police officers, including glass 64, modest thicknesses of metal, and most plastics.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. An adaptive projectile to be propelled through air and which is specially constructed for lateral expansion only upon impact with a sufficiently soft target, said projectile comprising:

an annular submunitions array comprised of a plurality of discrete submunition elements, each submunition element having a wedge surface defined by a portion of an interior funnel shape, a spreader operatively disposed within said submunitions array, said spreader having a flared ramp adapted to engage said wedge surfaces of said submunitions, a ballistic penetrator operatively disposed over said spreader, and a pressure-sensitive link disposed between said ballistic penetrator and said spreader, said pressure-sensitive link responsive to a predetermined threshold impact force to disable said spreader when the impact force on said ballistic penetrator is above said predetermined threshold and thereby inhibit lateral expansion of said submunitions array.

2. The projectile of claim 1 wherein said pressure-sensitive link is disposed and configured to transmit a compressive force directly from said ballistic penetrator to said spreader.

3. The projectile of claim 2 wherein said ballistic penetrator has a leading face and an opposite sheltered face, a ram centrally located on said sheltered face, said spreader having an anvil disposed opposite said ram, said pressure-sensitive link disposed directly between said anvil and said ram.

4. The projectile of claim 1 wherein said pressure-sensitive link is generally cylindrical.

5. The projectile of claim 1 wherein said pressure-sensitive link is fabricated from a material having a shatter strength less than approximately 400,000 psi.

6. The projectile of claim 1 wherein said pressure-sensitive link is fabricated from a spinel crystal structure.

7. The projectile of claim 1 wherein said ballistic penetrator has a leading face and an opposite sheltered face, each said submunition element having a leading end configured with a radially outer interlock portion, said interlock portion having a predetermined positive geometric shape, said sheltered face having a predetermined negative geometric shape generally complimenting said positive geometric shape of said interlock portions.

8. The projectile of claim 1 further including a base, said base having a guide, said guide including a generally cylindrical outer sidewall and a generally cylindrical inner sidewall, said inner sidewall forming a socket, said spreader having a shaft disposed for axial sliding movement within said socket of said guide.

9. The projectile of claim 8 wherein said base includes an annular platform disposed around said outer sidewall of said guide, each said submunition element having a foot disposed in direct surface contact with said platform, said foot having a rounded outer corner.

10. The projectile of claim 9 wherein said base includes an annular fillet in pressing contact with said foot of each said submunition element.

11. The projectile of claim 9 wherein each said submunition element includes a lower locator surface extending from said foot and disposed to engage said outer sidewall of said guide, said lower locator surface being cylindrically-concave to generally compliment said cylindrical outer sidewall of said guide, each said submunition element including an upper locator surface disposed above said lower locator surface, said upper locator surface at least partially overhanging said guide of said base, said upper locator surface being cylindrically-concave to generally compliment said cylindrical inner sidewall of said guide.

12. The projectile of claim 1 further including a generally cylindrical jacket enclosing said submunitions array and said spreader.

13. An adaptive projectile to be propelled through air and which is specially constructed for lateral expansion only upon impact with a sufficiently soft target, said projectile comprising:

a base, an annular submunitions array comprised of a plurality of discrete submunition elements disposed on said base, each submunition element having a wedge surface defined by a portion of an interior funnel shape, a spreader operatively disposed within said submunitions array, said spreader having a flared ramp adapted to engage said wedge surfaces of said submunitions, a ballistic penetrator operatively disposed over said spreader, a jacket enclosing said base and said submunitions array and said spreader, and a pressure-sensitive link disposed between said ballistic penetrator and said spreader, said pressure-sensitive link responsive to a predetermined threshold impact force to disable said spreader when the impact force on said ballistic penetrator is above said predetermined threshold.

14. The projectile of claim 13 wherein said base includes a guide, said guide having a generally cylindrical outer sidewall and a generally cylindrical inner sidewall, said inner sidewall forming a socket, said spreader having a shaft disposed for axial sliding movement within said socket of said guide.

15. The projectile of claim 14 wherein said ballistic penetrator has a leading face and an opposite sheltered face, a ram centrally located on said sheltered face, said spreader having an anvil disposed opposite said ram, said pressure-sensitive link disposed directly between said anvil and said ram disposed and configured to transmit a compressive force directly from said ballistic penetrator to said spreader.

16. The projectile of claim 15 wherein each said submunition element has a leading end configured with a radially outer interlock portion, said interlock portion having a predetermined positive geometric shape, said sheltered face having a predetermined negative geometric shape generally complimenting said positive geometric shape of said interlock portions so that said sheltered face of said ballistic penetrator can matingly engage said interlock portions of said submunitions array thereby retaining said submunition elements as a penetrating unit.

17. The projectile of claim 14 wherein said base includes an annular platform disposed around said outer sidewall of said guide, each said submunition element having a foot disposed in direct surface contact with said platform, said foot having a rounded outer corner.

18. The projectile of claim 17 wherein said base includes an annular fillet in pressing contact with said foot of each said submunition element.

19. The projectile of claim 17 wherein each said submunition element includes a lower locator surface extending from said foot and disposed to engage said outer sidewall of said guide, said lower locator surface being cylindrically-concave to generally compliment said cylindrical outer sidewall of said guide, each said submunition element including an upper locator surface disposed above said lower locator surface, said upper locator surface at least partially overhanging said guide of said base, said upper locator surface being cylindrically-concave to generally compliment said cylindrical inner sidewall of said guide.

20. An adaptive projectile to be propelled through air and wherein the projectile is specially constructed for lateral expansion only upon impact with a sufficiently soft target, said projectile comprising:

a base having a generally circular periphery, said base including a guide located concentrically with respect to said circular periphery, said guide having a generally cylindrical outer sidewall and a generally cylindrical inner sidewall, said inner sidewall forming a socket, said base including an annular platform disposed between said circular periphery and said outer sidewall of said guide, an annular submunitions array comprised of a plurality of discrete submunition elements upon said platform of said base, each said submunition element having a foot disposed in direct surface contact with said platform, said foot having a rounded outer corner, each said submunition element including a lower locator surface extending from said foot and disposed to engage said outer sidewall of said guide, said lower locator surface being cylindrically-concave to generally compliment said cylindrical outer sidewall of said guide, each said submunition element having a back surface extending from said foot, said back surface having a generally convex curvature to match said circular periphery of said base, each said submunition element having a leading end opposite said foot thereof, said leading end having a radially outer interlock portion and a radially inner wedge surface, said interlock portion extending from said back surface, said interlock portion having a predetermined positive geometric shape, said positive geometric shape of said interlock portion defined by a convex curvature terminating in a leading edge, said wedge surface disposed between said leading edge and said upper locator surface, said wedge surface having a curvature forming a portion of an interior funnel shape, a spreader operatively disposed on said base and centrally within said submunitions array, said spreader having a shaft disposed for axial sliding movement within said socket of said guide, said spreader having a flared ramp adapted to simultaneously engage said wedge surfaces of each said submunition, a ballistic penetrator operatively disposed over said spreader, said ballistic penetrator adapted to transmit an impact force to said spreader, said ballistic penetrator having a domed leading face and an opposite sheltered face, said leading face defined by a circular rim generally matched to said circular periphery of said base, said sheltered face having a predetermined negative geometric shape generally complimenting said positive geometric shape of said interlock portion, said negative geometric shape of said sheltered face defined by a concave curvature terminating adjacent said rim of said leading face, a generally cylindrical jacket enclosing said base and said submunitions array and said spreader, and at least one pressure-sensitive link disposed between said ballistic penetrator and said spreader, said pressure-sensitive link responsive to a predetermined threshold impact force to permit axial movement of said ballistic penetrator relative to said spreader so that said sheltered face of said ballistic penetrator can encircle said interlock portions of said submunitions array thereby retaining said submunition elements as a penetrating unit.

* * * * *